United States Patent [19]

Inoue

[11] 4,407,376

[45] Oct. 4, 1983

[54] UNDER-REAMING PILE BORE EXCAVATOR

[76] Inventor: Hachiro Inoue, 13-10, Kokubun 4-chome, Ichikawa-shi, Chiba-ken, Japan

[21] Appl. No.: 277,817

[22] Filed: Jun. 26, 1981

[30] Foreign Application Priority Data

Mar. 17, 1981 [JP] Japan ..... 56-037161[U]

[51] Int. Cl.[3] ..... E21B 7/28; E21B 10/32

[52] U.S. Cl. ..... 175/267; 175/283; 175/284; 175/288

[58] Field of Search ..... 175/281, 284, 285, 286, 175/288, 267, 283; 82/1.4, 1.5

[56] References Cited

U.S. PATENT DOCUMENTS

| | | | |
|---|---|---|---|
| 1,132,062 | 3/1915 | Bardeen | 175/286 |
| 1,621,812 | 3/1927 | Ross | 175/286 |
| 1,778,442 | 10/1930 | York | 175/285 X |
| 1,786,484 | 12/1930 | Duda | 175/288 X |
| 2,826,077 | 3/1958 | Walker | 175/288 X |
| 3,680,647 | 8/1972 | Dixon et al. | 175/325 |

FOREIGN PATENT DOCUMENTS

| | | |
|---|---|---|
| 50-24645 | 7/1975 | Japan . |
| 52-102801 | 8/1977 | Japan . |
| 52-161901 | 8/1977 | Japan . |

*Primary Examiner*—Stephen J. Novosad
*Assistant Examiner*—Joseph Fall
*Attorney, Agent, or Firm*—Lowe, King, Price & Becker

[57] ABSTRACT

An under-reaming pile bore excavator by which a straight pile bore is first excavated vertically to a given depth by rotating the main drill bits and the under-reamed bore is next excavated downward and outward into a given shape by rotating the slidable wing bits, allowing a relatively larger diameter ratio of the under-reamed pile bore to the straight pile bore. The under reamed pile bore excavator of the present invention comprises a plurality of guide rails disposed so as to cross the axis of the drill pipe, and a plurality of slidable wing bits mounted on the guide rails which excavate the under-reamed bore, in addition to the conventional main drill bits which can excavate the straight pile bore.

4 Claims, 7 Drawing Figures

UNDER-REAMING PILE BORE EXCAVATOR

BACKGROUND OF THE INVENTION

1. Field of the Invention

The present invention relates generally to an under-reaming pile bore excavator, and more particularly to an excavator such that an under-reamed part of a pile bore is excavated using a plurality of slidable wing bits moving downward and extending outward at the bottom of a straight pile bore along a plurality of guide rails fixed to a drill pipe at an appropriately inclined angle so as to cross the axis of the drill pipe in order to increase the diameter ratio of the under-reamed pile bore to the straight pile bore.

2. Description of the Prior Art

As an economical method of executing pile foundations, an under-reamed bore foundation is well known in which a larger diameter bore is excavated at the bottom of a straight pile bore to increase the end bearing capacity against a vertical load applied to the pile.

Conventionally, the method of reverse circulation drill excavation is used for executing these under-reamed pile foundations, in which the excavated soil is mixed by the rotational force applied to the main drill bits with water poured into the excavated pile bore and is pumped up to ground level through a bottom opening and the drill pipe.

In this method, however, since the under-reamed pile bore is excavated by extending the extendable wing bits horizontally by hydraulic cylinders without moving the wing bits downward, it is very difficult to form a stable impermeable surface layer preventing water from penetrating into the soil surface of the excavated bore and preventing lumps of soil from being dislodged therefrom, and additionally a relatively great torque is required to excavate the under-reamed part of the bore.

To overcome these problems in the prior-art under-reaming pile bore excavator, the inventor has already proposed a novel excavator disclosed under a patent application titled AN UNDER-REAMING PILE BORE EXCAVATOR AND METHOD OF ITS EXCAVATION. In the under-reaming pile bore excavator already proposed, however, it is difficult to excavate a larger-diameter under-reamed pile bore, compared with the straight pile bore, in order to further increase the end bearing capacity against a vertical load applied to the pile; in other words, it is difficult to increase the diameter ratio between the under-reamed pile bore and the straignt pile bore due to restrictions caused by its structure.

SUMMARY OF THE INVENTION

With these problems in mind therefore, it is the primary object of the present invention to provide an under-reaming pile bore excavator which can excavate a larger-diameter under-reamed pile bore compared with the straight pile bore, that is, increase the diameter ratio between the under-reamed pile bore and the straight pile bore, in addition to features such that a stable impermeable surface can be created on the wall of the excavated under-reamed pile bore while the under-reamed part of the bore is being excavated by applying a relatively small torque thereto.

To achieve the above-mentioned objects, the under-reaming pile bore excavator according to the present invention comprises a plurality of slidable wing bits movable downward along a plurality of guide rails and extendable outward to excavate the under-reamed part of the bore, in addition to a plurality of main drill bits used to excavate the straight pile bore, the guide rails of the wing bits being fixed to the drill pipe at an appropriately inclined angle with respect to the drill pipe so as to cross its axis.

In the under-reaming pile bore excavator according to the present invention, a straight pile bore is first excavated by the main drill bits provided at the tip of the excavator with the slidable wing bits held at their uppermost position, and then the under-reamed part of the pile bore is excavated by moving the slidable wing bits downward and by extending them outward along the guide rails, with the main drill bits in position at the bottom of the straight pile bore.

BRIEF DESCRIPTION OF THE DRAWINGS

The features and advantages of the under-reaming pile bore excavator according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

With reference to the attached drawings, there are explained preferred embodiments of the under-reaming pile bore excavator according to the present invention.

FIGS. 1(A), 1(B), 2 and 3 are illustrations of a first embodiment of the present invention, in which two sets of slidable wing bits are moved up and down by thrust applied to a drill pipe including sections 1*a* and 1*b* through a drill stem (not shown).

Figure 1A:
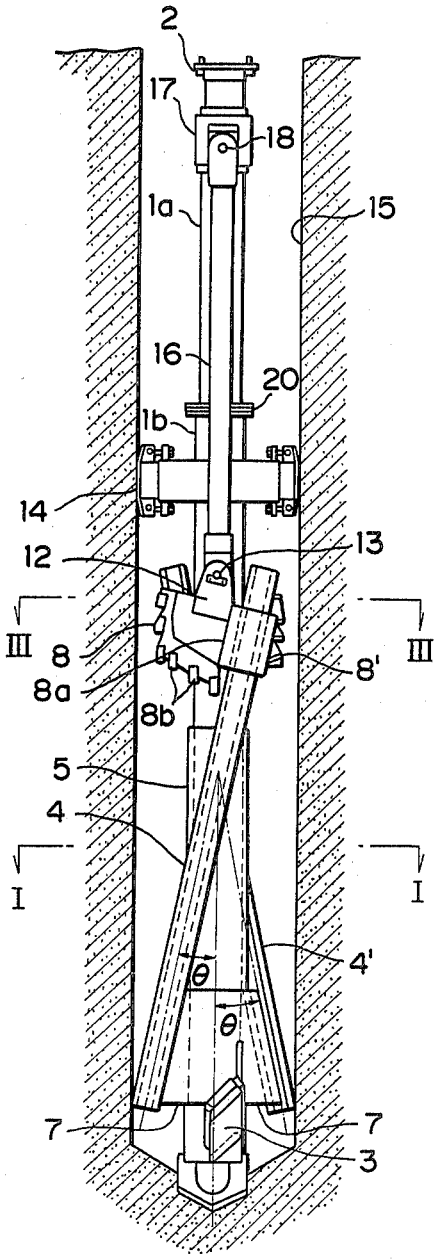
FIG. 1(A) is a side view of an under-reaming pile bore excavator of a first embodiment according to the present invention, indicating the state where the slidable wing bits are raised to their uppermost position.
Figure 1B:
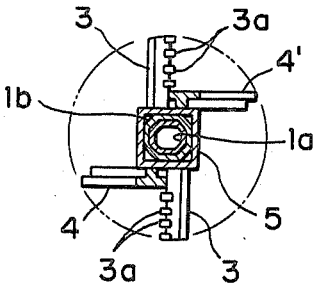
FIG. 1(B) is a sectional view of the under-reaming pile bore excavator of the first embodiment according to the present invention, taken along the lines I—I of FIG. 1(A)
Figure 2:
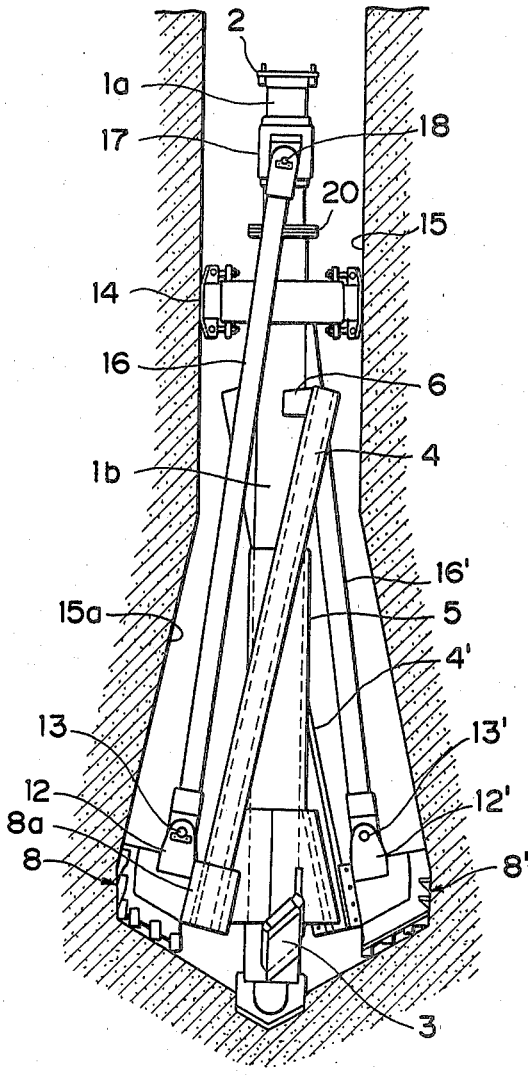
FIG. 2 is a side view of the under-reaming pile bore excavator of the first embodiment according to the present invention, indicating another state where the slidable wing bits are lowered to their lowermost position.

In the Figures, an inner pipe 1*a* forms an upper part of the drill pipe including an outer pipe 1*b* form the lower part of the drill pipe. Inner and outer pipes 1*a* and 1*b* are telescopically fitted one into the other in the axial direction thereof by using a splined shaft. At the top of the inner pipe 1*a*, a flange 2 is provided to link the pipe 1*a* with the drill stem (not shown). At the bottom of the outer pipe 1*b*, two main drill bits 3 are positioned to extend away from the outer pipe in the radial direction thereof at an appropriate bit angle. Bits 3 includes teeth 3*a* which project clockwise, as shown in FIG. 1(B). Two straight T-shaped guide rails 4 and 4' are attached, for instance, by welding to two outer parallel flat surfaces of a square pipe 5 (as in FIG. 1(B)) which is attached, for instance, by welding to the lower part of the outer pipe 1*b* forming the drill pipe. Rails 4 and 4' extend along the axial direction of the drill pipe 1 at an appropriately inclined angle $\theta$ (such as 12 degrees) so as to cross the drill pipe axis. In this embodiment, the top ends of the guide rails 4 and 4' are fixed to the outer pipe 1*b* by two connecting members 6, as shown in FIG. 2; and the bottom ends of the guide rails 4 and 4' are fixed to the outer pipe 1*b* by two other connecting members 7, as shown in FIG. 1(A). Two slidable wing bits 8 and 8' mounted move up and down freely along the guide rails 4 and 4', are moved by two connecting rods 16 connected by two pins 18 to a slide guide 17 fixed to the inner pipe 1*a*.

Figure 3:
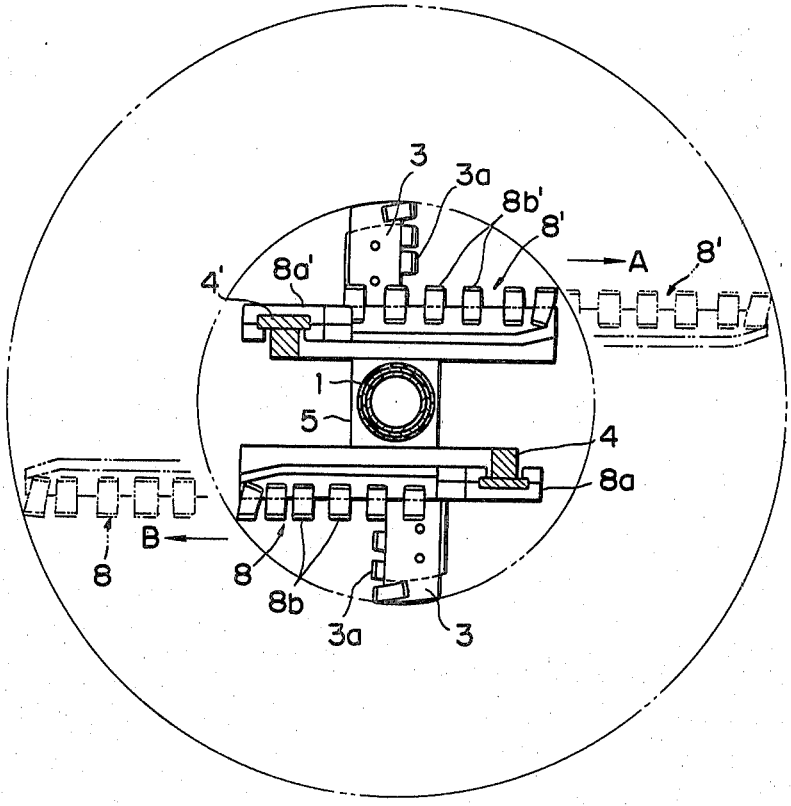
FIG. 3 is an enlarged sectional view of the under-reaming pile bore excavator of the first embodiment according to the present invention, taken along the lines III—III of FIG. 1.

As depicted in FIG. 3, the slidable wing bits 8 and 8' are so designed that two guide pieces 8*a* and 8*a'* are slidably supported by the guide rails 4 and 4', and a plurality of teeth 8*b* and 8*b'* are arranged on the respective guide pieces 8*a* and 8*a'* extending parallel to the guide rails 4 and 4' respectively projecting in opposite directions to each other. In this embodiment, the teeth 8*b* and 8*b'* project in the direction opposite to that of the teeth 3*a* and 3*a'* of the main drill bits 3, that is, in the counterclockwise direction in FIG. 3. A diameter-adjustable stabilizer 14 (FIGS. 1 and 2) is fixed to the top of the outer pipe 1*b*. The position of stabilizer 14 is a little higher than the uppermost position of the slidable wing bits 8 and 8'. Packing 20 seals a gap between the inner pipe 1*a* and outer pipe 1*b* tightly.

Further, in this embodiment, the stabilizer 14 is forms a stable impermeable soil surface on the excavated bore, when brought into contact therewith.

The method of using the under-reaming pile bore excavator according to the present invention is now described.

First, the drill stem (not shown) is connected to the flange 2 on the top of the inner pipe 1*a* to rotate it. Then the drill stem is rotated clockwise, as seen in FIG. 3, with the slidable wing bits 8 and 8' at the uppermost position as depicted in FIG. 1(A). By applying an appropriate thrust to the drill stem, it is possible to excavate a pile bore 15 (with a diameter, for instance, of 1200 mm). In this case, the excavated soil is mixed with water and sucked into the bottom opening of the outer pipe 1*a*, being pumped up to the ground level through the drill stem, that is to say, it is possible to excavate by the reverse circulation method.

Further, in this embodiment, when the drill pipe 1 is rotated clockwise, a locking mechanism (not shown), such as keys and key-ways, is engaged so that the inner pipe 1*a* and the outer pipe 1*b* are locked to each other to rotate together in the same direction without any relative axial movement. On the other hand, when the drill pipe 1 is rotated counterclockwise, the locking mechanism is disengaged so that the inner pipe 1*a* and the outer pipe 1*b* are unlocked in the axial direction to move freely with respect to each other, although the inner and outer pipes are rotated together in the same direction. Thereby, the clockwise rotation of the drill pipe can excavate the straight pile bore, and the counterclockwise rotation of the drill pipe excavates the under-reamed pile bore.

Accordingly, after the pile bore 15 has been excavated to a desired depth, the drill stem is rotated in the opposite direction with the main drill bits 3 in contact with the bottom of the excavated straight pile bore while applying an appropriate thrust to the inner pipe 1*a*. Since the main drill bits 3 and 3' are rotating in the non-excavation direction, the main drill bits 3 are left at the bottom thereof. The slidable wing bits 8 and 8' move along the guide rails 4 and 4' to expand gradually in the radial direction thereof upon application of thrust to the drill stem, as shown by arrows A and B in FIG. 3, so that it is possible to form a conical under-reamed pile bore 15*a'* at a vertical angle of $\theta$ which is the same as the inclined angle of the guide rails 4 and 4'. In this case, the excavated soil is also mixed with water and sucked into the bottom opening of the outer pipe and pumped up through the drill pipe and the drill stem, that is, it is possible to excavate according to the reverse circulation method. In this embodiment, the maximum diameter of the under-reamed pile bore 15*a* is approximately 2400 mm in the case of the above-mentioned excavated pile bore of 1200 mm, that is, the ratio of the two diameters is about two.

The reason why it is possible to increase the diameter ratio of the under-reamed pile bore to the straight pile bore so much is that the guide rails 4 and 4' are fixed to the outer surfaces of the square pipe 5 at an inclined angle of $\theta$ with respect to the axis of the drill pipe so as to cross it; that is, it is possible thus to excavate the small-diameter straight pile bore 15. When the drill pipe is raised to ground level after the under-reamed pile bore 15 has been excavated, first the slidable wing bits 8 and 8' go to the uppermost position thereof along the guide rails 4 and 4', and thereafter the outer pipe 1*b* and the main drill bits 3 and 3' are raised together.

Figure 4A:
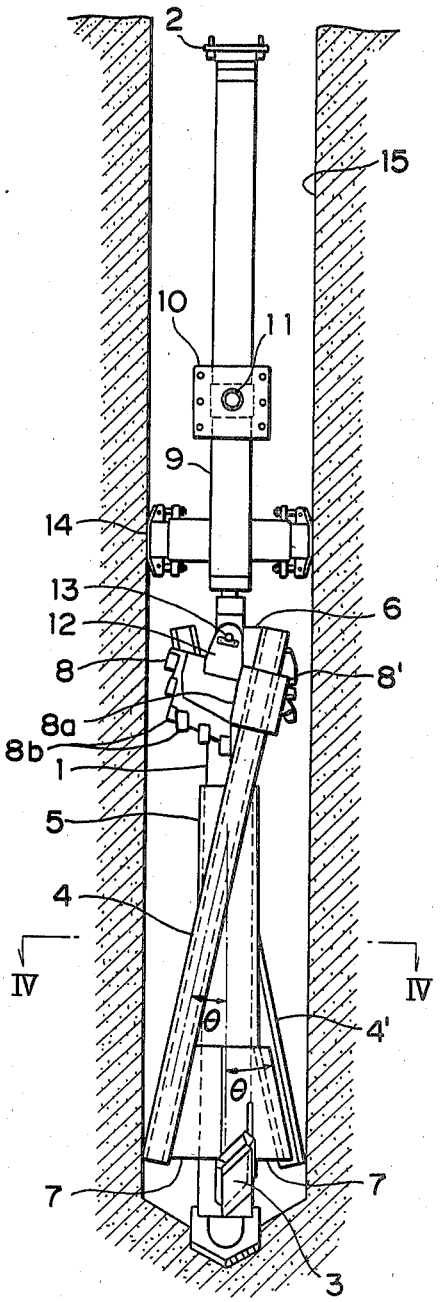
FIG. 4(A) is a side view of an under-reaming pile bore excavator of a second embodiment according to the present invention, indicating the state where the slidable wing bits are raised to their uppermost position.
Figure 4B:
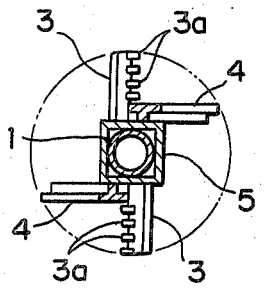
FIG. 4(B) is a sectional view of the under-reaming pile bore excavator of the second embodiment according to the present invention, taken along the lines IV—IV of FIG. 4(A)

FIG. 4 is an illustration of a second embodiment of the under-reaming pile bore excavator according to the present invention, in which the slidable wing bits are driven by hydraulic jacks 9 and 9' to excavate the under-reamed pile bore within a required stroke, and a single pipe is used for the drill pipe 1. The middle portions of the hydraulic jacks 9 and 9' are rotatably supported by a trunnion pin 11 provided on a trunnion block 10, fixed to the drill pipe 1. The lower ends of the jack rods 9*a* and 9*a'* are linked to the respective brackets 12 and 12' by two pins 13 and 13'.

The method of using the second embodiment of the under-reaming pile bore excavator according to the present invention is now described.

Figure 5:
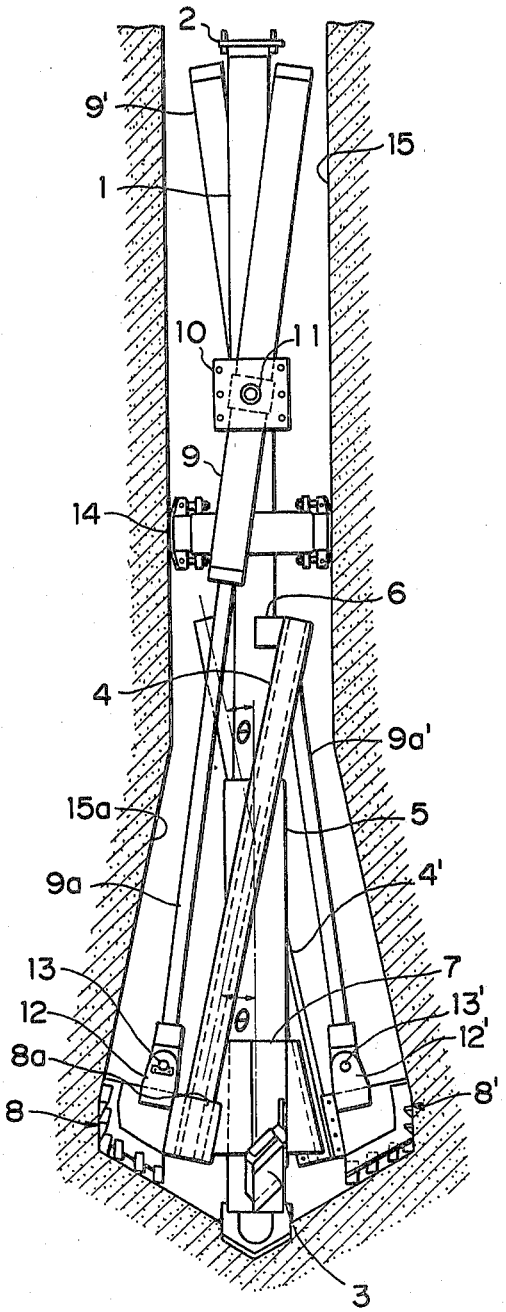
FIG. 5 is a side view of the under-reaming pile bore excavator of the second embodiment according to the present invention, indicating another state where the slidable wing bits are lowered to their lowermost position.

To excavate the under-reamed pile bore, the drill pipe is rotated counterclockwise with the main drill bits 3 in contact with the bottom of the excavated straight pile bore and the slidable wing bits 8 and 8' are moved downward by actuating the hydraulic jacks 9 and 9' respectively, so that it is possible to form a conical under-reamed pile bore 15*a* at a vertical angle of $\theta$ which is the same as the inclined angle of the guide rails 4 and 4', as shown in FIG. 5. In this embodiment, it is unnecessary to change the direction of rotation of the drill pipe; that is, it is possible to excavate the straight pile bore and the under-reamed pile bore by rotating the drill pipe in the same direction.

As described hereinabove, since the guide rails are fixed to the outer surfaces of the drill pipe extend along the axis thereof at an appropriately inclined angle to cross the axis, it is possible to increase the ratio of the diameter of the under-reamed excavated pile bore to the straight excavated pile bore; that is, it is possible to execute an under-reamed pile bore foundation which can increase the end bearing capacity against a vertical load applied to the pile.

It will be understood by those skilled in the art that the foregoing description is in terms of preferred embodiments of the present invention wherein various changes and modifications may be made without departing from the spirit and scope of the invention, as is set forth in the appended claims.

(Reference Numerals)

1 . . . Drill pipe,
1*a* . . . Inner pipe,
1*b* . . . Outer pipe,
3 . . . Main drill bits,
4,4' . . . T-shaped guide rails,
5 . . . Square pipe,
8,8' . . . Slidable wing bits,
8*a*,8*a'* . . . Guide pieces,
9,9' . . . Jacks,
9*a*,9*a'* . . . Jack rods,
10 . . . Trunnion block,
11 . . . Trunnion pin,
14 . . . Stabilizer,
16 . . . Connecting rod,
17 . . . Slide guide

What is claimed is:

1. An under-reaming pile bore excavator which comprises:

(a) an inner pipe to which an excavating torque is applied;

(b) an outer pipe telescopically connected to said inner pipe, said outer pipe being rotated together with said inner pipe in either direction;

(c) a plurality of main drill bits fixed to the bottom of said outer pipe at an appropriate bit angle to excavate a straight pile bore;

(d) a plurality of guide rails fixed to said outer pipe at an inclined angle with respect to the axis of said outer pipe, said plurality of guide rails being disposed so as to obliquely cross the axis of said outer pipe;

(e) a plurality of slidable wing bits slidably mounted on said guide rails at an appropriate bit angle to excavate an under-reamed pile bore when moved downward and outward along said guide rails, said slidable wing bits being rotated in a direction opposite to that of said main drill bits; and (f) a plurality of connecting rods for connecting said slidable wing bits to said inner pipe so that said slidable wing bits can extend in the radial direction along said guide rails, whereby a straight pile bore is first excavated by said main drill bits with said slidable wing bits fixed in their uppermost position and then the under-reamed pile bore is next excavated by moving said slidable wing bits downward and extending them outward along said guide rails so that a greater ratio of the diameters of the under-reamed pile bore and the straight pile bore can be obtained.

2. An under-reaming pile bore excavator which comprises:

(a) a drill pipe to which an excavating torque is applied;

(b) a plurality of jacks rotatably supported at an appropriate position on said drill pipe, said plurality of jacks being rotated together with said drill pipe;

(c) a plurality of main drill bits fixed to the bottom of said drill pipe at an appropriate bit angle to excavate a straight pile bore;

(d) a plurality of guide rails fixed to said drill pipe at an inclined angle with respect to the axis of said drill pipe, said plurality of guide rails being disposed so as to obliquely cross the axis of said drill pipe;

(e) a plurality of slidable wing bits slidably mounted onto said guide rails at an appropriate bit angle to excavate an under-reamed pile bore when moved downward and outward along said guide rails; and (f) a plurality of jack rods for connecting said slidable wing bits to said jacks so that said slidable wing bits can extend in the radial direction along said guide rails.

3. An under-reaming pile bore excavator as set forth in claim 1 which further comprises a stabilizer for forming a stable impermeable surface on the soil wall of the excavated straight pile bore, said stabilizer being fixed to said outer pipe at a position above the uppermost position of said slidable wing bits.

4. An under-reaming pile bore excavator as set forth in claim 2 which further comprises a stabilizer for forming a stable impermeable surface on the soil wall of the excavated straight pile bore, said stabilizer being fixed to said drill pipe at a position above the uppermost position of said slidable wing bits.

* * * * *